United States Patent [19]

Harney

[11] Patent Number: 4,764,995

[45] Date of Patent: Aug. 23, 1988

[54] DUAL FLUSH MECHANISM

[76] Inventor: Donald E. Harney, 1113 Highway 99 North, Eugene, Oreg. 97402

[21] Appl. No.: 148,886

[22] Filed: Jan. 27, 1988

[51] Int. Cl.[4] ..... E03D 3/12

[52] U.S. Cl. ..... 4/325; 4/382

[58] Field of Search ..... 4/324, 325, 379, 381–384

[56] References Cited

U.S. PATENT DOCUMENTS

| | | | |
|---|---|---|---|
| 519,337 | 5/1894 | Moloney | 4/382 |
| 3,091,775 | 6/1963 | Himmelrick | 4/325 |
| 4,175,296 | 11/1979 | Goldman | 4/325 |
| 4,530,119 | 7/1985 | Chiu et al. | 4/324 |

*Primary Examiner*—Charles E. Phillips
*Attorney, Agent, or Firm*—John F. Ingman

[57] ABSTRACT

A dual flush mechanism which allows the user to select either a full or partial flush, while using a single flush valve. A full flush is obtained by a first handle which lifts a flush valve actuating arm to unseat the flush valve in a conventional manner. For a partial flush, a second handle rotates and lifts a partial-flush control arm which extends beneath the flush valve actuating arm. Upward movement of the control arm is limited. Release of the second handle permits the control arm to rotate downwards until stopped by the engagement of a portion of the control arm with a transversely extending rack extension, thereby keeping the flush valve in an unseated position. As the tank water level lowers, a partial-flush float also lowers, pulling down the end of a lever which pivots with an attached pinion gear, toothed with a rack to linearly retract a rack extension from engagement with the control arm. This permits the control arm to drop, reseating the flush valve. With the refilling of the tank, the partial-flush float rises, permitting the lever, assisted by a counterweight, to rotate with its pinion gear so as to cause the rack extension to move into pressured contact against the control arm in preparation for the next partial-flush cycle.

1 Claim, 3 Drawing Sheets

DUAL FLUSH MECHANISM

BACKGROUND OF THE INVENTION

1. Field of the Invention

The present invention generally relates to dual flush mechanisms for toilets, and, more particularly, a dual flush mechanism which utilizes only a single flush valve.

2. Description of the Prior Art

Various dual flush toilet mechanisms have been developed over the years for the purpose of providing the user with a choice of a "short" or partial flush to carry away liquid waste and a "long" or full flush for solid waste. The benefit of a dual flush arrangement is the potential savings of large quantities of water in times where water is becoming an increasingly scarce and valuable commodity.

Previous dual flush mechanism designs have characteristically used two separate flush valves, the full flush valve being located at a low level within the tank to receive a full volume of water, and the partial flush valve being located at mid-level within the tank to receive only a portion of the tank volume. In order to replace conventional flushing mechanisms with such dual flush mechanisms, it was necessary to replace both the pre-existing conventional single flush valve, and its associated plumbing, with a two flush valve configuration, a prospect which was too complicated or costly for the ordinary user.

What is needed is a dual flush mechanism which operates with only a single flush valve, and which is simple to install and maintain.

SUMMARY OF THE INVENTION

The present invention provides a dual flush mechanism which is designed to safisfy the aforementioned needs. The invention involves a a dual flush mechanism which provides either a full or partial flush capability utilizing only a single flush valve.

Accordingly, in the preferred embodiment, the invention comprises a dual flush mechanism which allows the user to select, by handle control means, either a full or partial flush. A full flush is obtained by a first handle control means which lifts a flush valve actuating arm. The flush valve actuating arm is attached, by a flexible connecting member, to the flush valve, wherein lifting of the arm unseats the flush valve and permits a full flush in a conventional manner. To achieve a partial flush, a second handle control means rotates and lifts a partial-flush control arm which extends beneath, and contacts during the partial flush cycle, the flush valve actuating arm. Upward movement of the partial-flush control arm is limited, thereby restricting the corresponding lift of the flush valve actuating arm, and of the flush valve. Release of the second handle control means permits the partial-flush control arm to rotate downwards until stopped by the engagement of the partial-flush control plate, an portion of the partial-flush control arm, with a transversely extending shaft or rack extension, thereby also limiting the downward movement of the flush valve actuating lever and keeping the flush valve in an unseated position with associated water flow from the tank. As the water level in the tank lowers, a partial-flush float also lowers, pulling down a flexibly connected end of a partial-flush control lever which pivots, along with an attached pinion gear, about a pivot axis. Rotation of the pinion gear, which is toothed with a rack, moves the rack, and an associated rack extension, linearly, thereby retracting the rack extension from engagement with the partial-flush control plate. This disengagement permits the partial-flush control arm to drop, thus allowing the flush valve actuating arm to lower and the flush valve to reseat, so as to terminate the flow of water from the tank. With the refilling of the tank in the conventional manner, the partial-flush float also rises, permitting the partial-flush control lever, assisted by an attached counterweight, to re-rotate about its pivot axis so as, by the attached pinion gear, to cause the rack and associated rack extension to move outwards until it presses against the side of the partial-flush control plate in preparation for the next partial-flush cycle.

DESCRIPTION OF THE PREFERRED EMBODIMENT

Figure 1:
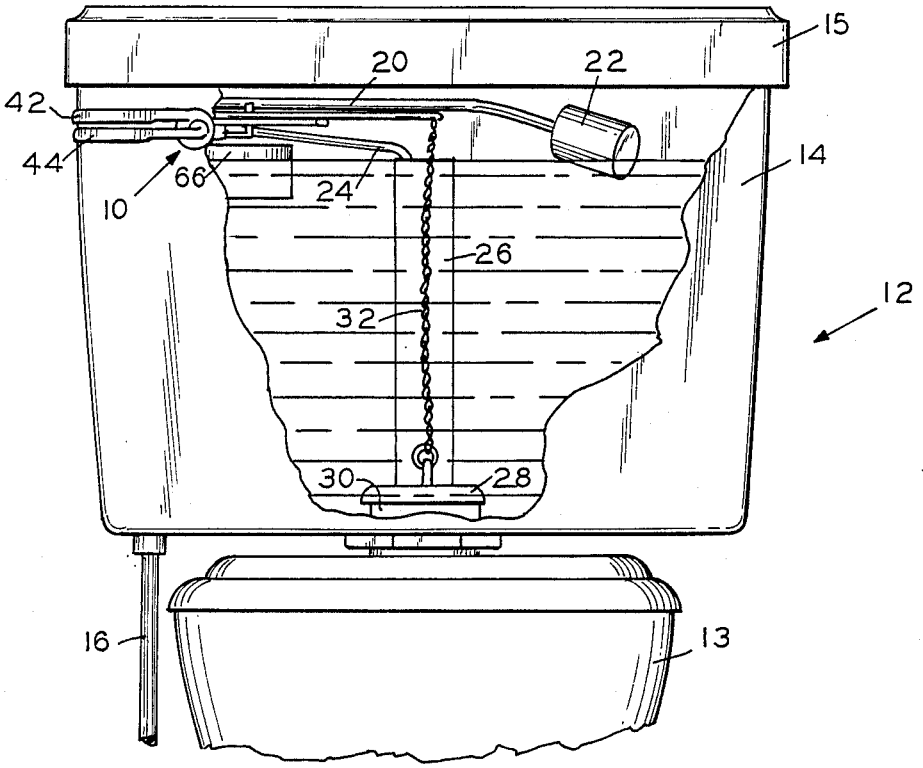
FIG. 1 illustrates a front view of a toilet with water tank having the dual flush mechanism installed therein.
Figure 2:
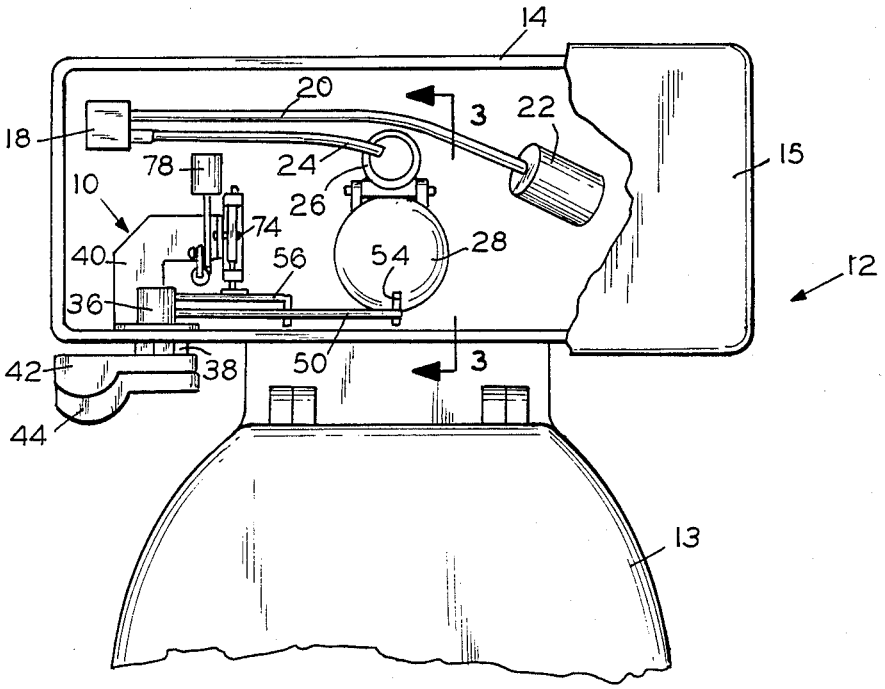
FIG. 2 illustrates a top view of the toilet with water tank having the dual flush mechanism installed therein.

Turning now to the drawings, and particularly to FIG. 1 and FIG. 2, there is shown the preferred embodiment of the dual flush mechanism 10 as installed in a common toilet 12 with bowl 13 and water tank 14 with tank top 15. Conventional components within the tank include a water inlet pipe 16 terminating at an inlet valve 18 operated by an arm 20 and float 22 combination. Post-flush filling of bowl 13 is accomplished by a tube 24 carrying water from the inlet valve 18 and into the overflow standpipe 26. A flush valve 28 of the flapper valve type rests upon the flush valve seat 30 with a connection, normally flexible, and illustrated as a chain 32, which extends upwardly to connect with the dual flush mechanism 10. The above components are conventional within the tank 14 of a toilet 12 and are not inventive subject matter.

What is unique is the dual flush mechanism 10 which is installed as an entity to permit the capability of either a partial flush for liquid waste or a full flush for solid waste matter.

Figure 9:
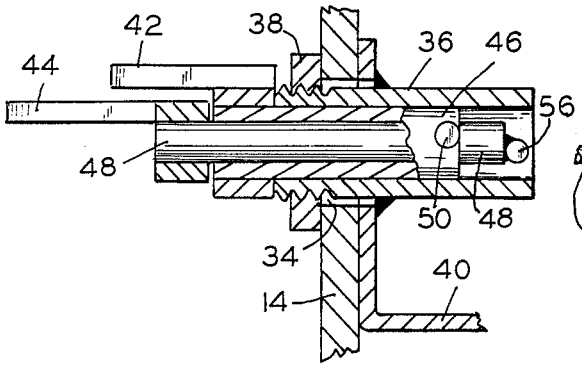
FIG. 9 illustrates a sectional view as seen a line 9—9 of FIG. 8.
Figure 8:
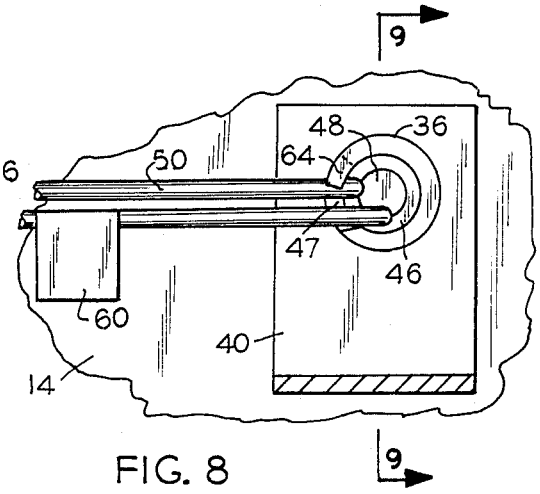
FIG. 8 illustrates a sectional view as seen at line 8—8 of FIG. 7.

The dual flush mechanism 10 is attached through and supported at the conventional hole 34, formed in the water tank 14 for the normal single flush handle, by means of a tubular handles support casing 36 and the nut 38. A support base 40, fixedly attached to the handles support casing 36 supports the remainder of the dual flush mechanism 10. In the preferred embodiment, two separate handles 42 and 44 are utilized, wherein they are connected to, and operate, the mechanism by concentric shafts 46 and 48 respectively which extend through the handles supports casing 36 (as best seen at FIG. 8 and FIG. 9). As will be described subsequently, handle 42 and outer shaft 46 correspond to the full flush, and handle 44 with inner shaft 48 operates the partial flush.

Extending from outer shaft 46, through a notch 47 in the handles support casing 36, is a flush valve actuating arm 50, which arm 50 extends roughly horizontally from outer shaft 46 to a position above the flush valve 28 there it is connected at its outer end 52, as by chain 32, to the lifting connection 54 of the flapper-style flush valve 28. The handle 42, outer shaft 46, flush valve actuating arm 50, chain 32 and flush valve 28 act in combination to provide a full flush similar to the full flush of the conventional toilet, wherein rotation of the handle 42 and its shaft 46 pivots the outer end 52 of the flush valve actuating arm 50 upwards, thereby, through chain 32, lifting the flush valve 28 to permit the egress of water through the flush valve seat 30. Upon the lowering of the water level in the tank 14 so that the flush valve 28 is no longer supported fully open by the flow of water, the flush valve 28 closes upon the valve seat 30 and the egress of water from the tank 14 in the full flush mode is terminated.

Handle 44 is attached to the inner shaft 48 which extends slightly further into the tank 14 than outer shaft 46. At the end of inner shaft 48, a partial-flush control arm 56 is fixedly attached, the partial-flush control arm 56 extending, also through notch 47 in the handle support casing 36, essentially parallel and beneath the flush valve actuating arm 50. In the preferred embodiment, the partial-flush control arm 56 has at its outer ebd a ninety degree bend or hook 58 so that the partial-flush control arm 56 extends transversely beneath the flush valve actuating arm 50, thereby assuring contact of the flush valve actuating arm 50 from beneath by the partial-flush control arm 56 even with an amount of transverse displacement of the partial-flush control arm 56.

A partial flush is initiated by downward pressure on handle 44 so as to rotate upwards the hook end 58 of the partial-flush control arm 56. The partial-flush control arm 56, being beneath and in contact with the flush valve actuating arm 50, thereby causes the flush valve actuating arm 50 to raise at its outer end 52, so as to, by means of chain 32, lift the flush valve 28 from the flush valve seat 30. However, upward movement of the partial-flush control arm 56 is restricted by limit member 64 which extends downward from the handles support casing 36 into notch 47 so as to physically block further upward movement of the partial-flush control arm 56. Therefore, the flush valve actuation arm 50 can only be raised a limited distance by the partial-flush control arm 56, and the flush valve 28 is not lifted from the flush valve seat 30 to the extent that it is in the full flush mode of operation, such partial-flush unseating being seen at FIG. 2.

Figure 3:
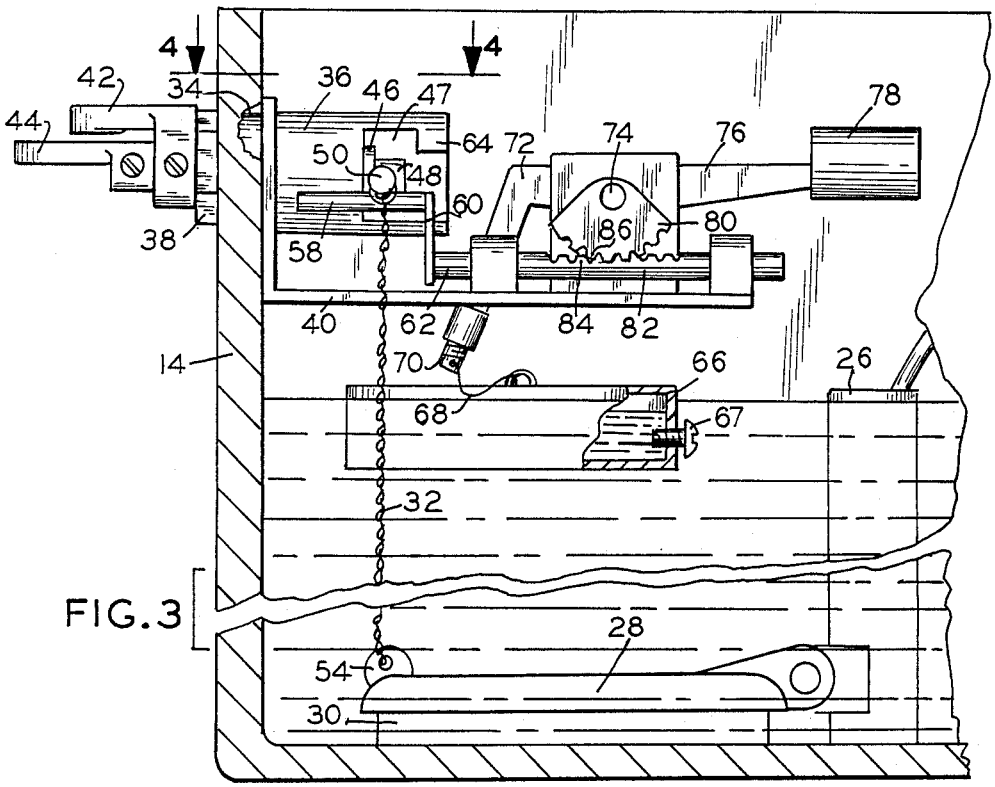
FIG. 3 illustrates a partial sectional view of the dual flush mechanism as seen at line 3—3 of FIG. 2, with the mechanism in a pre-flush configuration.
Figure 4:
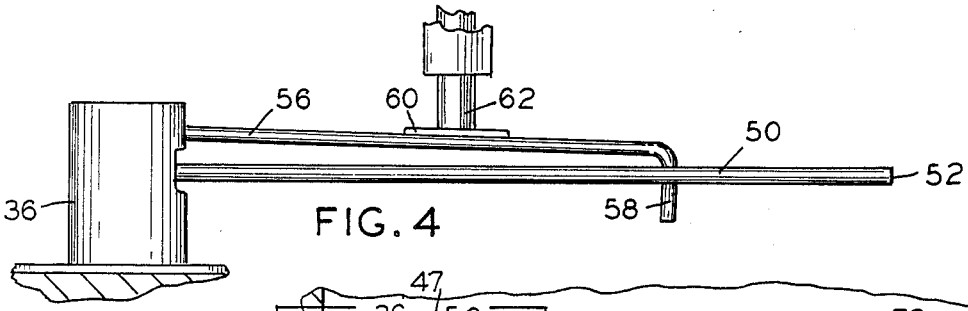
FIG. 4 illustrates a partial sectional view of the dual flush mechanism as seen at line 4—4 of FIG. 3.
Figure 5:
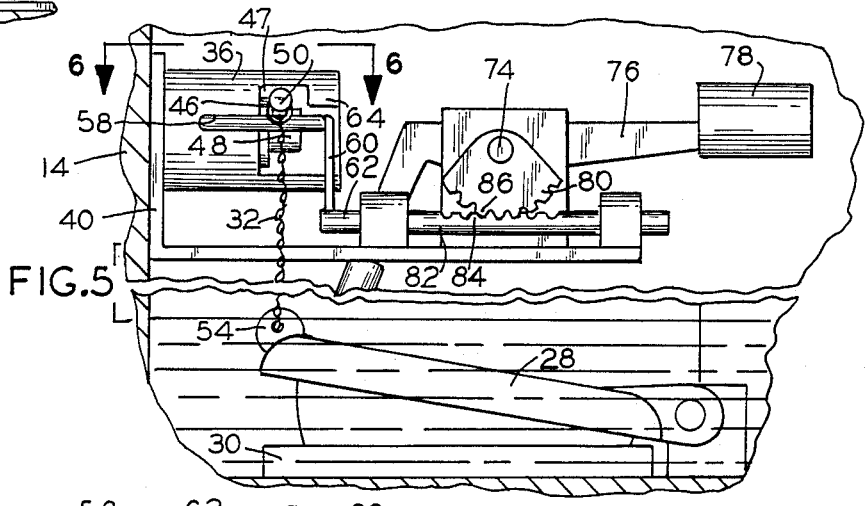
FIG. 5 illustrates a partial sectional view of the dual flush mechanism, during the initial part of the partial flush cycle.
Figure 6:
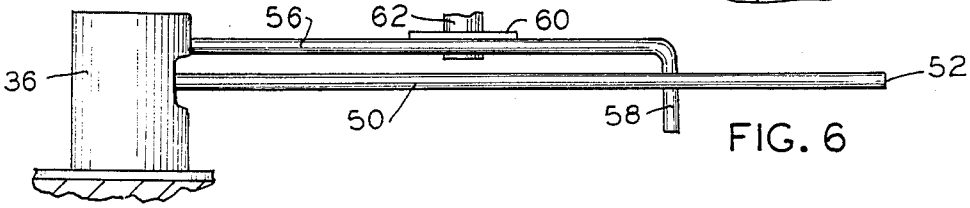
FIG. 6 illustrates a partial sectional view of the dual flush mechanism as seen at line 6—6 of FIG. 5.

Attached to, or formed with, the partial-flush control arm 56 is a partial-flush control plate 60, best seen in FIG. 8, which extends vertically downward from the partial-flush control arm 56, interim its attachment to shaft 48 and its outer end 58. In the pre-flush configuration, as illustrated in FIG. 3 and FIG. 4, a rack extension 62 presses against the partial-flush control plate 60. When the partial-flush control arm 56 is raised, the partial-flush control plate 60 is lifted clear of the rack extension 62. The rack extension 62 will then extend further outwards, to a position beneath the raised partial-flush control plate 60, as is discussed subsequenlty. When the handle 44 is released, the partial-flush control arm 56 rotates back downwards so that the partial-flush control plate 60 rests atop the rack extension 62, as best seen in FIG. 5 and FIG. 6. The partial-flush control arm 56 thus is held at an elevated position, and consequently the flush valve actuating arm 50 holds the flush valve 28 in the partial open position to permit continuing egress of water during this portion of the partial flush cycle.

As the water level decreases a weighted partial-flush float 66 lowers within the tank 14. The partial-flush float 66 is attached by a flexible connection 68 to an end 70 of a partial-flush control lever 72. The partial-flush control lever 72 pivots about pivot axis 74. The second end 76 of the partial-flush control lever 72 has attached thereto a counterweight 78. The partial-flush float is weighted to offset the effect of the counterweight 78. A method of variably weighting the partial-flush float is by the introduction of water into a hollow float 66, as may be accomplished by removal of a screw 67 located in the float 66.

Figure 7:
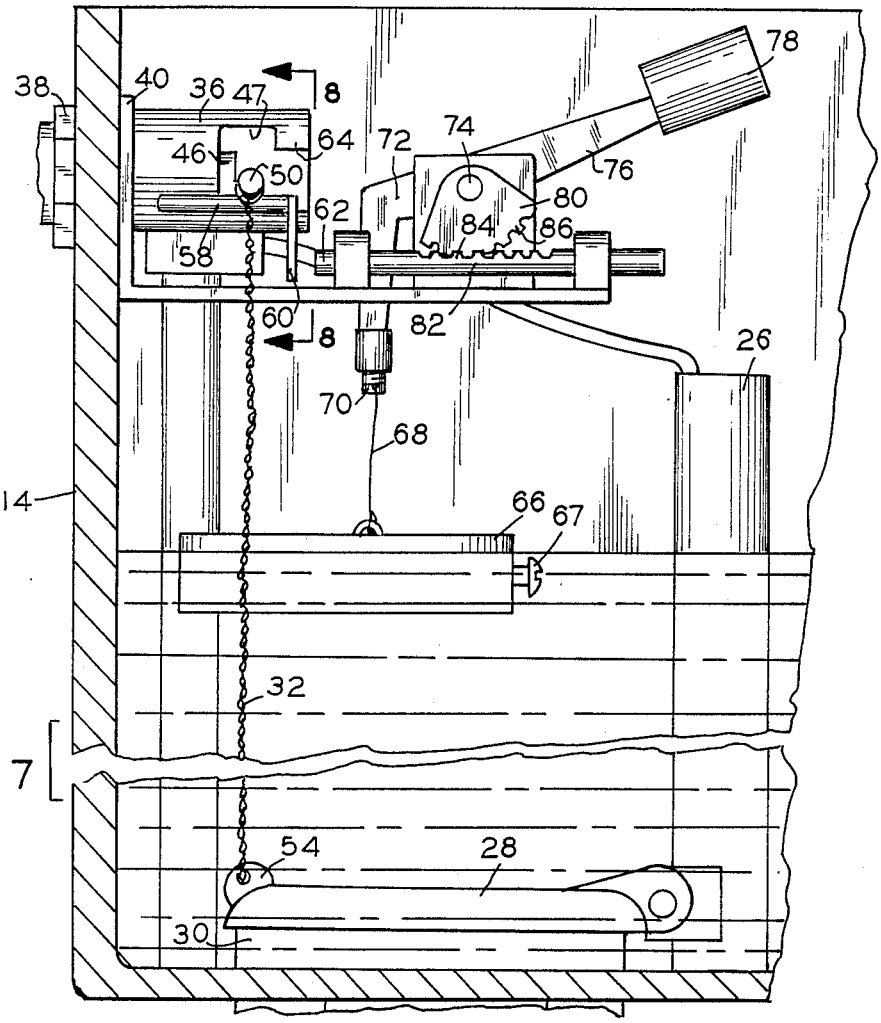
FIG. 7 illustrates a partial sectional view of the dual flush mechanism during tank refilling during a flush cycle.

A pinion gear 80 is attached to the partial-flush control lever 72 at the pivot axis 74 so as to rotate about the pivot axis 74 with the partial-flush control lever 72. A rack 82, with teeth 84 formed to gear with the teeth 86 of the pinion gear 80, operates with that pinion gear 80 in a conventional manner, that is, rotation of the pinion gear 80 produces linear movement of the rack 82. Therefore, as the partial-flush float 66 is lowered by the egress of water, the end 70 of the partial flush control lever 72 will be pulled downwards, thereby rotating the partial-flush control lever 72 about pivot axis 74. The pinion gear 80 also rotates about pivot axis 74 which moves the rack 82, and displaces the rack extension 62 from beneath the partial-flush control plate 60, as seen in FIG. 7. The partial-flush control arm 56 and its hook end 58 can then drop downwards, which also permits the end 52 of the flush valve actuating arm 50 to fall, thus allowing the flush valve 28 to reseat, stopping the flow of water from the tank 14 so as to result in a partial flush.

As the tank 14 refills conventionally, the partial-flush float 66 rises in the tank 14 so as to permit the partial-flush control lever 72 to pivot about the pivot axis 74 in the opposite direction due to gravitational force from the counterweight 78. Such pivoting movement causes the pinion gear 80 to rotate so as to linearly move the rack 82, and the rack extension 62, towards and into pressured contact against the side of the partial control plate 60. When the partial-flush control arm 56 is lifted to clear the rack extension 62, the rack extension 62, by means of counterweight 78, partial-flush control lever 72, pinion gear 80 and rack 82, extends further outward to a position beneath the partial-flush control plate 60. The rapidity of this movement of the rack extension 62 will depend on the mass of the counterweight 78 and the length of the portion of the partial-flush control lever 72 between the pivot axis 74 and the counterweight 78. A two-ounce weight on a 1½ inch arm has proved to be effective.

It is thought that the dual flush mechanism of the present invention and its many attendant advantages will be understood from the foregoing description and that it will be apparent that various changes may be made in form, construction and arrangement of the parts thereof without departing from the spirit and scope of the invention or sacrificing all of its material advantages, the forms hereinbefore stated being merely exemplary embodiments thereof.

I claim:

1. A dual flush mechanism, to provide a full-flush and a partial-flush capability for toilets with a tank, in combination with a single flush valve, which dual flush mechanism comprises:

a. a flush valve actuating arm, having a first end and a second end, attached near or at its second end to the flush valve by means of a flexible connecting member;

b. a first handle control means, to which the first end of the flush valve actuating arm is attached;

c. wherein the combination of first handle control means, flush valve actuating arm, flexible connecting member, and flush valve comprise the full flush capability;

d. a partial-flush control arm, having a first end and a second end, the partial-flush control arm extending essentially parallel to, and beneath, the flush valve actuating arm;

e. a second handle control means, to which the first end of the partial flush control arm is attached;

f. means for limiting upward rotational movement of the second end of the partial-flush control arm due to operation of the second handle control means, thereby also limiting resulting upwards rotational movement of the second end of the flush valve actuating arm due to the upward movement of the second end of the partial-flush control arm located beneath the flush valve actuating arm;

g. a partial-flush control plate, attached to said partial-flush control arm;

h. a partial-flush control lever, having a first end and a second end, pivotally supported interim said first and second ends at a pivot axis;

i. a partial-flush float, attached by a flexible connecting member to said first end of said partial-flush control lever;

j. a partial-flush counterweight attached to said second end of said partial-flush control lever;

k. a pinion gear attached to said partial-flush control lever at the location of pivotal support of the partial-flush control lever so as to rotate about said pivot axis;

l. a rack, toothed to gear with said pinion gear;

m. a rack extension attached to or formed as part of said rack so as to provide for engagement with said control plate;

n. wherein movement of the second handle control means will pivot the second end of the partial-flush control arm upwards, to the extent permitted by the upward movement limiting means, thereby lifting the second end of the flush valve actuating arm a limited distance, and, through the flexible connecting member, lifting the flush valve a limited distance to permit egress of water from the tank; subsequent release of the second handle control means permitting the partial-flush control arm to rotate downwards until the lower edge of the control plate rests against the transversely extending rack extension, thereby also limiting the downward movement of the flush valve actuating lever and keeping the flush valve in a partially open position with associated continuing water egress; said water egress lowering the position of the partial-flush float, thereby pulling the first end of the partial-flush control lever downwards and rotating the partial-flush control lever about its pivot axis; thereby rotating said pinion gear about the pivot axis, the pinion gear rotation causing the rack, and the associated rack extension, to retract out from beneath the partial-flush control plate, said retraction freeing restraint on the partial-flush control arm, allowing further downward movement of the partial-flush control arm, with a corresponding downward movement of the flush valve actuating arm and the reseating of the flush valve to as to terminate the egress of water from the tank; with refilling water raising the water level of the tank, the partial-flush float correspondingly rising, the first end of the partial-flush control lever, assisted by the counterweight at its second end, being lifted so as move the lever about its pivot axis and so rotate the pinion gear so as to cause the rack, and the rack extension, to move outwards until in pressured engagement against the side of the partial-flush control plate of the partial flush control arm, thereby terminating the partial flush cycle by the dual flush mechanism.

* * * * *